United States Patent [19]

Webb

[11] Patent Number: 4,685,567

[45] Date of Patent: Aug. 11, 1987

[54] NESTABLE, STACKABLE TOTE BOXES

[75] Inventor: Daniel D. Webb, Troy, Mich.

[73] Assignee: Peninsula Plastics Company, Inc., Auburn Hills, Mich.

[21] Appl. No.: 929,899

[22] Filed: Nov. 13, 1986

[51] Int. Cl.[4] ..... B65D 21/06; B65D 21/02; B65D 43/16; B65D 51/24

[52] U.S. Cl. ..... 206/506; 206/508; 206/518; 220/331; 220/337; 220/343

[58] Field of Search ..... 206/505, 506, 508, 515, 206/518; 220/331, 333, 334, 337, 343

[56] References Cited

U.S. PATENT DOCUMENTS

| | | | |
|---|---|---|---|
| 2,112,451 | 3/1938 | Best | 206/506 |
| 3,165,225 | 1/1965 | Reitzel | 220/343 |
| 3,463,345 | 8/1969 | Bockerstette | 206/508 |
| 3,900,106 | 8/1975 | Cantales | 206/519 |
| 4,161,261 | 7/1979 | Frater | 206/508 |
| 4,213,539 | 7/1980 | Reuter | 220/333 |
| 4,391,386 | 7/1983 | Moret | 220/343 |
| 4,572,374 | 2/1986 | Sirotkin | 206/518 |

*Primary Examiner*—George E. Lowrance
*Attorney, Agent, or Firm*—Cullen, Sloman, Cantor, Grauer, Scott and Rutherford

[57] ABSTRACT

A nestable, open-top container has a cover formed of two separate, co-planar pieces, each covering one-half of the open top. Each cover piece is hingedly connected to one side of the upper edge of the container and extends toward and overlaps the opposite side, that is, the side to which the other cover piece is hinged. The cover pieces' adjacent edges engage each other and their remote edges overlap and are supported upon their adjacent container upper edge portions. Each cover piece may be slid sidewise upon its hinge so that it can be spaced from the container upper edge portion which it otherwise overlaps wherein it can be swung either inside or outside of the container. When the cover pieces are arranged in co-planar covering positions, a number of boxes can be stacked, and when they are swung outwardly or inwardly of the container, the boxes may be nested.

12 Claims, 11 Drawing Figures

NESTABLE, STACKABLE TOTE BOXES

BACKGROUND OF INVENTION

Tote boxes are containers commonly used in industry for holding, storing and shipping industrial parts or finished goods. Typical tote boxes may comprise open top, bin-like containers which may loosely receive parts, such as machined elements. The sizes and shapes of said boxes vary considerably, depending upon the objects which they are intended to contain.

In typical use, tote boxes are filled with finished or partly finished parts or goods and then they may be transported to a different location for unloading. Thereafter, if they are made of fiberboard or other board-like material, they typically are discarded. If they are made of a sturdy, more expensive material, they may be re-used. However, to reuse the tote boxes, they must be returned empty to their initial point of loading.

It is frequently desirable to close the tops of the loaded tote boxes to protect the parts contained therein. Consequently, sturdy covers are needed for this purpose. Also, in order to make the shipping or movement of the boxes more efficient, it is desirable to stack the boxes one upon another. Thus, when the boxes are empty, the covered, stacked empty boxes take up as much space as the filled boxes. Therefore, it would be desirable to reduce the amount of volume occupied by each box when the box is empty and particularly, when it is in transit to the point where it will be re-filled.

Because of the expense of shipping bulky empty boxes, frequently they have been discarded rather than returned for reuse. Moreover, the shipping of empty boxes has typically resulted in considerable damage to the boxes as they have been relatively free to move somewhat, due to their light weight, and to strike against each other while in transit.

Some common forms of tote boxes, such as fiberboard boxes and wood boxes, are relatively flammable which requires additional precautions in storing and using them. Also, because they can be damaged relatively easily, they are not suitable for multiple reuses.

There has long been a need for strong, inexpensive, substantially fire-proof, damage resistant containers which can be repeatedly reused as tote boxes and which can be stacked when full and nested when empty to facilitate and reduce the cost of shipping and handling the boxes. This invention relates to such improved containers or tote boxes.

SUMMARY OF THE INVENTION

The invention herein contemplates a tote box formed of a plastic molded container having sloped sidewalls so that the containers can be nested one within the other. The containers are provided with molded plastic covers or lids which are made of two, normally co-planar pieces, each hingedly connected to an opposite upper portion of the container. Each cover portion is narrower than the upper, open top of the container so that together they close the container. Each cover piece is preferably made of two hinged together sections which can be folded together or extended in a co-planar direction to overlap the adjacent edges of the container.

The invention further contemplates that the cover pieces will be hingedly connected by means of a hinge which permits them to be swung either inside or outside of the container and also, slid sideways relative to the hinge so that the cover pieces may be moved off the supporting portions of the container upper edge. Consequently, the two cover pieces can be arranged co-planar, with their adjacent edges engaged, for covering the contents of the container or the cover pieces can be swung open, outside of the container, with their two cover sections folded together, so that the containers may be stacked one within another after they are emptied. Alternatively, the cover pieces may be swung inwardly of the container where desired.

The simple container and cover construction provides a low-cost tote box which is unusually rugged and capable of supporting substantial loads without damage to the tote boxes. Moreover, the tote boxes can be stacked one upon another, for shipping them when they are filled. Importantly, they can be nested, when empty, to reduce the cost of shipping empty tote boxes back to their points of re-use so that they may be repeatedly reused.

One object of this invention is to form a reusable tote box, which can be made of a suitable plastic material that will reduce any flammability problems encountered in the use of wood or fiberboard tote boxes, yet which is inexpensive enough to permit it to replace previously used materials.

A further object of this invention is to provide a nestable, stackable tote box which can be molded out of suitable plastic materials so that it can be made very inexpensively. Further, the tote boxes may be molded into sizes which permit maximum utilization of standard support pallets upon which tote boxes are typically supported and moved during shipment. Further, their cover constructions permit transporting the tote boxes in close proximity, side by side, on a standard pallet, both when the boxes are filled and when they are empty.

These and other objects and advantages of this invention will become apparent upon reading the following description, of which the attached drawings form a part.

DETAILED DESCRIPTION

Figure 1:
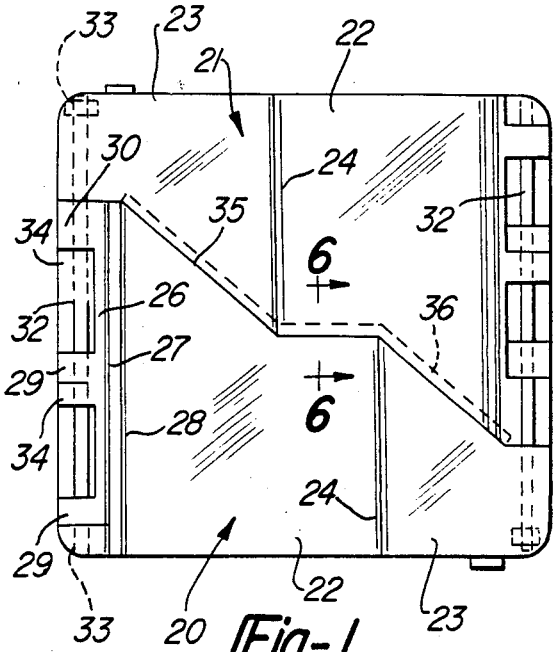
FIG. 1 is a top, plan view of the tote box with its cover closed.

The tote box is molded out of a suitable plastic material, such as a commercially available polypropylene material which is strong, generally inert to weather conditions, and rigid enough for the intended purpose. Thus, the box is formed of a molded container 10 having sloping walls 11 whose upper edges are thickened into a flange or widened upper end 12. The flange provides opposed side edges 13 and 14, between which are transverse edges 15 and 16 (see FIG. 9). The bottom of the container may be molded with integral legs 17. This provides a space between the legs to receive a lift element, such as the fork of a lift truck.

The sloping walls 11 of the container permit the nesting of one container within another. The walls of the container may be of uniform thickness, as for example, about one-eighth of an inch thick. However, the thickness will be determined by the size of the container and the expected load.

The tote box cover is formed as two identical cover pieces 20 and 21. Each piece is made of a base part or section 22 upon which is hinged an end part or section 23. The cover pieces are molded in one piece and the hinges are formed as V-shaped indentations providing integral hinges 24.

Integral with the base part or section of each cover piece is a hinge strip 26 which is provided with integral hinges 27 and 28 made of V-shaped indentations. Molded integral with the hinge strip are short, hinge lugs 29 and long, end hinge lugs 30.

An elongated hinge pin 32 is mounted on each of the opposed side edges 13 and 14 by means of container end lugs 33 at the corners of the container and intermediate lugs 34, through which the hinge pins are inserted. The cover lugs 29 and 30 are centrally bored to receive the hinge pins 32.

The hinge construction permits each of the cover pieces to pivot around their hinge pins so that the cover pieces may be swung either inwardly or outwardly of the container. In addition, the hinge lugs on the cover hinge strips are sufficiently loose so that the cover pieces may be slid sidewise, i.e. endwise of the hinge pins.

Figure 2:
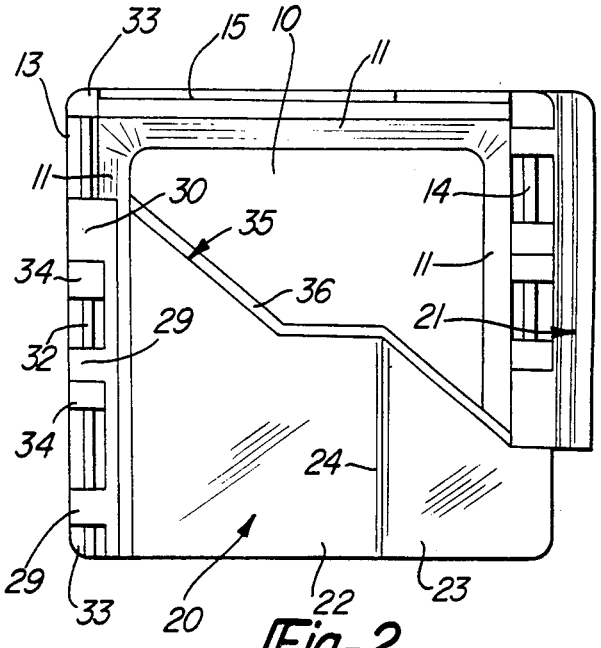
FIG. 2 is a top, plan view, but with one piece of the cover swung open.
Figure 6:
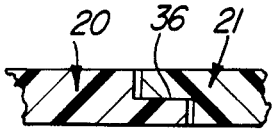
FIG. 6 is an enlarged, fragmentary, cross-sectional view taken in the direction of arrows 6—6 of FIG. 1 and showing the engagement between the adjacent edges of the two cover pieces.

As can be seen in FIGS. 1 and 2, the cover pieces are each narrower than the width of the open top of the container. Each cover piece has a slanted or angled inner edge 35 which is provided with a rabbited edge 36. One rabbited edge overlaps the other in order to seal the cover pieces together, as illustrated in FIG. 6.

Figure 4:
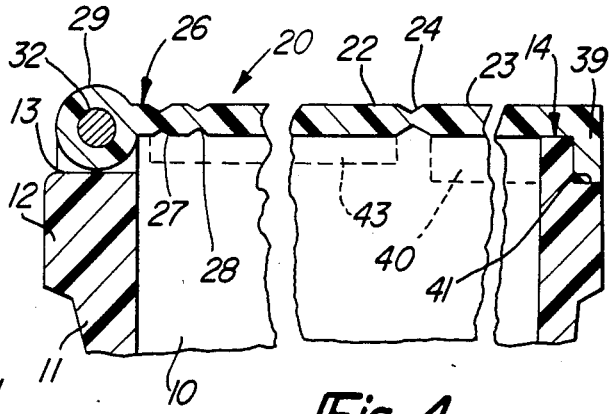
FIG. 4 is an enlarged, fragmentary, cross-sectional view showing the cover section and the upper edge portions of the container.

The free end of each cover piece, that is, the free end of the end part or section 23 of the cover piece, is provided with a downwardly depending edge flange 39 which continues along the outer edge of each end section 23, forming edge flanges 40 thereon (see FIG. 4). These edge flanges fit into a deep rabbited indentation 41 formed on the upper edge of the container flange 12.

An edge flange 43 is formed on the outer edge of the base parts 22 of each of the cover pieces. These flanges fit into edge rabbits or indentations 44 formed on the upper outer edges of the container flange 12 (see FIG. 10).

Figure 3:
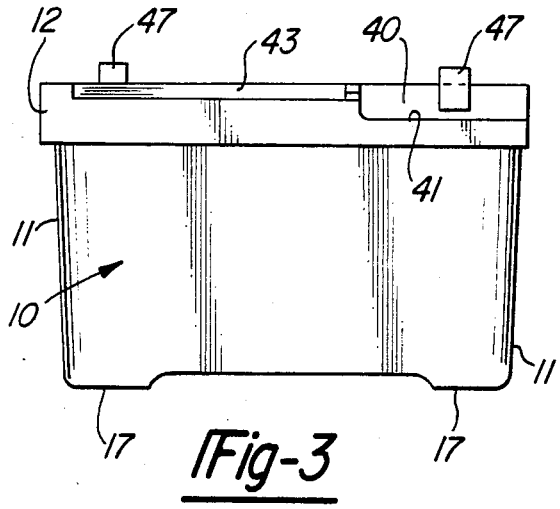
FIG. 3 is a front, elevational view of the tote box.

Short guide tabs 47 are secured to the outer edges of the cover pieces, as illustrated in FIG. 3, in order to guide and position the cover piece base and end sections when they are folded, as will be described below.

Figure 9:
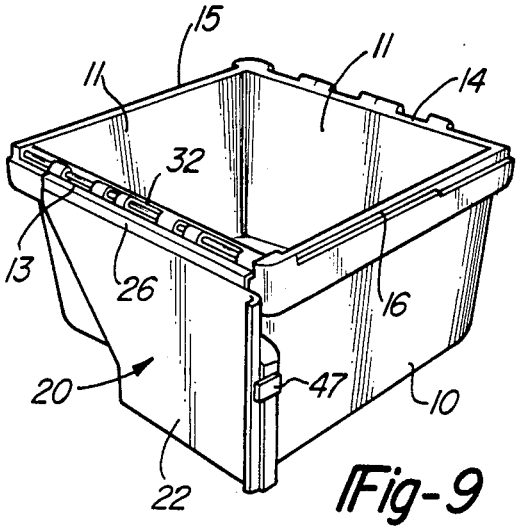
FIG. 9 is a perspective view showing the cover pieces open and on the outside of the container.
Figure 10:
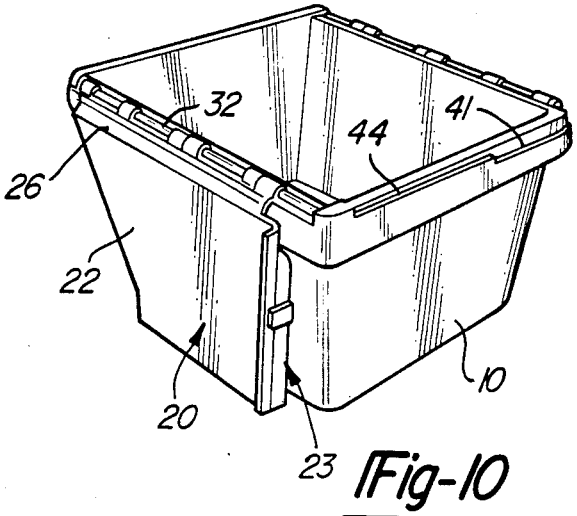
FIG. 10 is a view, similar to FIG. 9, but showing the cover sections moved sideways on their hinges.
Figure 11:
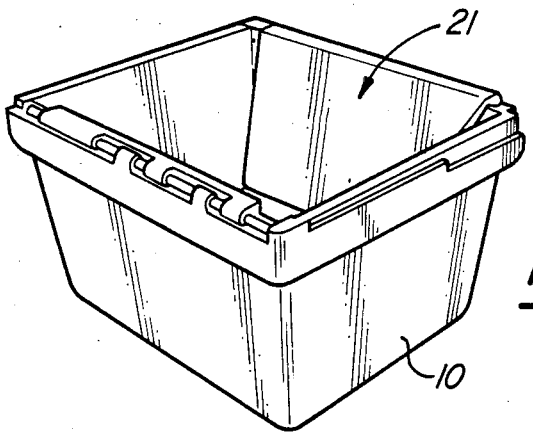
FIG. 11 is a perspective view showing the cover pieces swung inside of the container.

In operation, the cover of the tote box is opened by swinging the two cover pieces outwardly into the positions shown in either FIGS. 9 or 10. The tote boxes may then be filled with parts or whatever contents are desired. By way of example, in a machine shop, machined engine parts can be put into the tote box.

Figure 8:
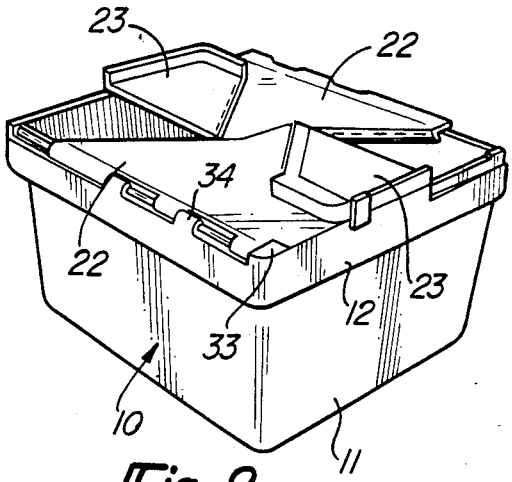
FIG. 8 is a perspective view showing the cover end sections swung open.

When the tote box has been sufficiently loaded, the covers are folded back over the open top, by swinging them into the position shown in FIG. 8 where the cover piece bases overlap each other along their adjacent edges and overlap the transverse edges of the container along their outer edges. Next, the cover piece end sections 23 are folded over until their flanges 39 and 40 fit into the rabbit indentations 41. The cover pieces are now arranged substantially co-planar and completely cover the container.

Figure 7:
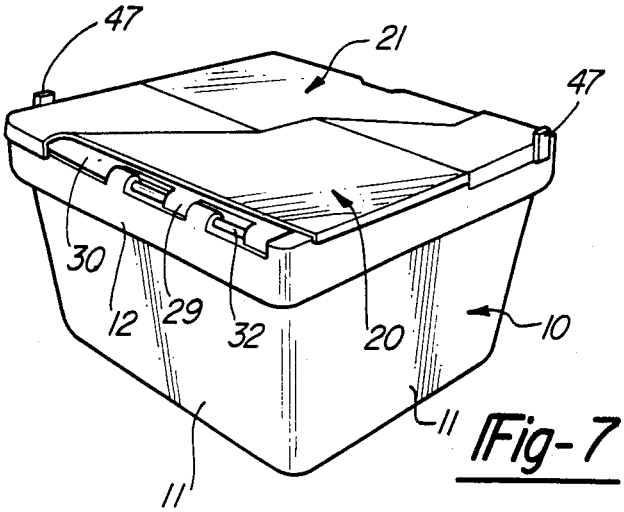
FIG. 7 is a perspective view of the tote box with the cover closed.

When the cover pieces are co-planar, as shown in FIGS. 1 and 7, tote boxes may be stacked one upon another. In typical factor operations, it is conventional to take standard size tote boxes and place them upon standard size wood pallets. A number of such tote boxes may be placed upon the pallets, side by side, to fill a pallet. Thus, the tote boxes here are preferably made of a size to fit side by side upon a conventional pallet. The pallet supports them and permits a number of them to be lifted simultaneously by a fork truck for positioning upon a transport, such as a truck or railroad car.

When the tote boxes are brought to their unloading place, the covers are opened by folding the cover end sections 23 back over the base sections 22 and then swinging the base sections around the hinge pins 32 until the cover pieces drop down along the outside of the containers as illustrated in FIGS. 9 and 10. Then the tote boxes may be unloaded.

After the tote boxes are unloaded, because of the arrangement of the covers and the nesting ability of the containers, a number of them may be nested, one within another. This reduces the amount of volume needed to ship a large number of empty tote boxes back to the point where they will be reused.

Figure 5:
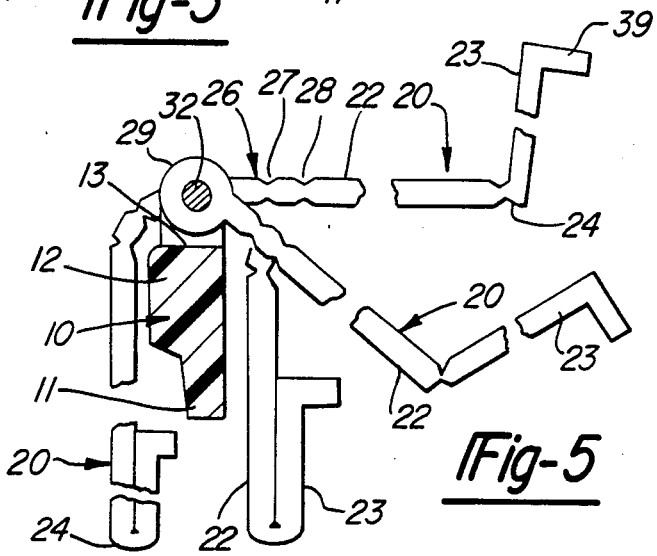
FIG. 5 is an enlarged, schematic view, showing the bending of the cover sections.

Alternatively, the covers may be turned so that they are folded inside of the container. This is accomplished by sliding the covers sidewise upon the hinge pins into the position shown in FIG. 10. They may be left there on the outside of the container or alternatively, as mentioned above, may be pivoted around into the interior of the container, as shown schematically in FIG. 5. When they are folded within the container, a number of tote boxes may be nested within each other, although not as deeply as when the covers are outside. Nevertheless, when the covers are inside, the tote boxes do not occupy any more space on the pallets than when they were full. Sine they may be nested, a considerably larger number of tote boxes may be shipped to their point of origin in a single load than were shipped when they were filled.

The sizes and shapes of the tote boxes may vary from the square shape shown in the drawings to a rectangular shape, to curved or rounded shapes. The thickness of the walls and of the cover pieces may be varied depending upon anticipated loads and the sizes of the tote boxes. For one typical size tote box useful in the factory, the cover and may be made of polypropylene with a wall thickness of about one-eighth of an inch and with the integral hinge indentation being about 0.08 inches thick.

Having fully described an operative embodiment of this invention, I now claim:

1. A nestable, stackable tote box comprising:

an open top container shaped to nest within a similar container, and having an upper edge with a pair of opposed, horizontal side edge portions;

a pair of generally flat cover pieces, each formed of an inner part and an outer part which are hingedly connected together end-to-end, and with each cover piece spanning the container open top between the pair of opposed side edge portions;

hinge means connecting one of the outer cover parts to one of the container side edges and the other cover outer part to the opposed cover side edge, with the cover outer parts each being narrower than the lengths of their respective side edges and said hinge means permitting sidewise movement of each of the cover outer parts relative to its respective container side edge, as well as axial pivoting movement of the cover outer part into and out of the container;

each of said cover pieces being sidewise movable into a covering position wherein the pieces are substantially co-planar and wherein its outer and inner parts are supported upon the container transverse edge portions, that is, the portions that are located between the container side edge portion to which it is hinged and the opposed container side edge portion to which the other cover piece is hinged, and with the adjacent edges of the cover pieces engaging each other to completely close the container open tops;

and each of the cover pieces being pivotable and endwise movable into a non-covering position wherein it is out of contact with the container edge portion upon which it may be supported and instead, it extends downwardly along the outside or the inside of the container, with the inner cover part pivotallly folded generally parallel to the outer cover part for nesting one container within another.

2. A construction as defined in claim 1, and said hinge means comprising elongated, rod-like hinge pins extending through bored hinge lugs formed upon the opposed container side edge portions and the cover outer parts, with the cover pieces being movable axially endwise, as well as pivotally, about the hinge pins, so that the covers may be moved to a portion between and spaced from the transverse edge portions of the container.

3. A construction as defined in claim 2, and said hinge pins extending along substantially the full length of each of the container opposed side edge portions and the width of the cover pieces being substantially less than the lengths of the container side edge portions to which they are hinged.

4. A construction as defined in claim 2, and said hinge lugs being formed upon bendable hinge strips integral with each of the cover outer parts at their edges which are adjacent to their respective container side edge portions, wherein the cover pieces can be pivoted about their hinge pins and also bent about their hinge strips for folding them either inside of or outside of the container.

5. A construction as defined in claim 1, and with the adjacent edges of each of said cover outer parts being angled, at an acute angle, from the outer edge of the part, that is, the edge which is hingedly connected to the container side edge portion, toward the inner edge of the part, that is, the edge which is hingedly connected to the cover inner part;

and with one of the angled edges being arranged to overlap the other when the cover pieces are extended for covering the container.

6. A construction as defined in claim 5, and with each of the cover inner part adjacent edges being angled at an acute angle, from its hinged connection to its outer part toward its outer free edge;

and with one of such angled edges of one cover inner part arranged to overlap the corresponding inner part angled edge of the other cover piece when the cover pieces are extending for covering the container.

7. A construction as defined in claim 6, and with the free edges of each of the cover inner parts being arranged to rest upon and be supported by the container side edge portion to which its other cover part is hingedly connected.

8. A nestable, stackable tote box comprising:

an open-top container shaped to nest within a similar container, and having an upper edge, defining its open top, formed with a pair of opposed side edge portions between which are transverse edge portions;

a cover formed of a pair of cover pieces which normally are arranged co-planar and which, together, close the open top of the container;

each of said cover pieces being hingedly connected to one of the container side edges and extending toward and having its free end overlapping and supported upon the opposite container side edge portion, and also overlapping and being supported upon its adjacent transverse edge portion;

each of said cover pieces being narrower than the length of the container side edge portion upon which it is hinged;

hinge means connecting each of the cover pieces to its respective container side edge portions, said hinge means being formed to permit its cover piece to pivot around the axis of the hinge either into or out of the container and also permitting the cover piece to move sidewise, i.e. longitudinally, of the container side edge to where the cover piece is unsupported by the container transverse edge upon which it is normally supported;

whereby the cover pieces may be arranged co-planar, extending over the open top of the container so that one container may be stacked upon another, or alternatively, the cover pieces may be swung outwardly or inwardly of the container and the containers, when empty, may be nested with similar containers.

9. A nestable, stackable tote box as defined in claim 8, and including each of said cover pieces being divided into two sections which are hingedly connected together, namely an inner section which is hingedly connected to the container side edge portion and an outer section which extends to and overlaps the opposite container side edge portion;

each of said cover piece outer sections being foldable against its inner section when the cover piece is swung either outwardly or inwardly of the container.

10. A nestable, stackable tote box as defined in claim 9, including each of said cover pieces being considerably narrower than the container side edge portion upon which it is hinged;

and said hinge means comprising elongated hinge pins extending along the length direction of their respective side edge portions and extending through hinge lugs which may freely move along the length of the pins as well as pivot around the pins, with the hinge pins and lugs being connected with the container side edge portion and cover piece for enabling the cover piece to be moved sideways off its supporting container transverse edge.

11. A nestable, stackable tote box as defined in claim 10, and including the adjacent edges of the cover pieces being formed to engage and overlap one another for closing the container open top when the cover pieces are extending in their co-planar position across the container.

12. A nestable, stackable tote box as defined in claim 11, and including the adjacent edges of the coverpieces being angled, at an acute angle, relative to their outer cover section edge which is hingedly connected to the container side edge portion, with the adjacent cover piece edges formed of corresponding shape to enable them to engage and overlap.

* * * * *